US007211005B2

(12) United States Patent
Lindsay

(10) Patent No.: US 7,211,005 B2
(45) Date of Patent: May 1, 2007

(54) GOLF CLUBS

(76) Inventor: Norman Matheson Lindsay, 19 Batchelors Way, Amersham, Buckinghamshire HP7 9AH (GB)

( * ) Notice: Subject to any disclaimer, the term of this patent is extended or adjusted under 35 U.S.C. 154(b) by 0 days.

(21) Appl. No.: 10/420,104

(22) Filed: Apr. 18, 2003

(65) Prior Publication Data

US 2003/0199332 A1 Oct. 23, 2003

(30) Foreign Application Priority Data

| | | |
|---|---|---|
| Apr. 20, 2002 | (GB) | 0209060.3 |
| May 9, 2002 | (GB) | 0210581.5 |
| Jul. 23, 2002 | (GB) | 0217023.1 |
| Sep. 2, 2002 | (GB) | 0220353.7 |

(51) Int. Cl.
*A63B 53/02* (2006.01)

(52) U.S. Cl. ..... 473/310; 473/313; 473/314; 473/340; 473/345; 473/316

(58) Field of Classification Search ..... 473/345–346, 473/314, 313, 310, 340, 316, 305
See application file for complete search history.

(56) References Cited

U.S. PATENT DOCUMENTS

| | | | | |
|---|---|---|---|---|
| 1,525,137 A | | 2/1925 | Lawton | |
| 3,693,978 A | * | 9/1972 | East | 473/314 |

(Continued)

FOREIGN PATENT DOCUMENTS

| | | | |
|---|---|---|---|
| GB | 2 225 726 A | | 6/1990 |
| GB | 2 303 796 A | | 3/1997 |
| GB | 2 331 939 A | | 6/1999 |
| GB | 2381204 | | 4/2003 |
| JP | 4-82574 | * | 3/1992 |
| WO | 98/28051 | | 7/1998 |

OTHER PUBLICATIONS

Ashby, M.A., "Materials Selection in Mechanical Design", 2d ed., Oxford: Butterworth-Heinemann, 1992, pp. 46-48.

(Continued)

*Primary Examiner*—Stephen Blau
(74) *Attorney, Agent, or Firm*—Davis Bujold & Daniels, P.L.L.C.

(57) ABSTRACT

Golf clubs, of putter and wood-type especially, each include an attachment between shaft and club head which is of a compliance to allow the club head to behave more closely as a 'free-body' in providing vertical gear-effect when striking the ball. The compliance is related to freeing the club head for rotation about an axis 35 which extends through the center of mass 31 with an orientation perpendicular to the shaft axis 37 in a plane parallel to the shaft axis 37 and containing the heel-toe axis 34 through the center of mass 31. In this regard, the compliance about axis 35 is not less than the force-couple bending compliance of a length of 1000/K, or 3000/K, or more preferably 10000/K, millimeters of the shaft measured from the tip-end. The rotational axis 35 is spaced by less than 0.33K millimeters, or not more than 4,25 or less than 2 millimeters, from the shaft axis 37. The center of mass 31 is located not less than 10 millimeters, and preferably not less than 15 millimeters, behind the impact face, and is not more than 13 millimeters, and preferably not more than 10 millimeters, above the sole of the club. The spacing DD between the shaft-attachment 38 and the rotational axis 35 is less than 2K millimeters or preferably less than K millimeters.

18 Claims, 7 Drawing Sheets

U.S. PATENT DOCUMENTS

| | | | | | |
|---|---|---|---|---|---|
| 4,157,830 | A | | 6/1979 | Taylor et al. | 273/167 G |
| 4,725,062 | A | | 2/1988 | Kinney, III | 273/175 |
| 5,094,457 | A | * | 3/1992 | Kinoshita | 473/314 |
| 5,301,941 | A | * | 4/1994 | Allen | 473/327 |
| 5,451,048 | A | | 9/1995 | Magamoto | |
| 5,505,447 | A | | 4/1996 | Mockovak | |
| 5,685,784 | A | | 11/1997 | Butler | 473/340 |
| 5,749,793 | A | * | 5/1998 | Lucetti | 473/324 |
| 5,851,160 | A | * | 12/1998 | Rugge et al. | 473/349 |
| 5,888,149 | A | | 3/1999 | Allen | 473/309 |
| 5,931,742 | A | | 8/1999 | Nishimura et al. | 473/305 |
| 5,935,020 | A | * | 8/1999 | Stites et al. | 473/345 |
| 5,961,397 | A | | 10/1999 | Lu et al. | 473/327 |
| 6,033,318 | A | | 3/2000 | Drajan, Jr. et al. | 473/309 |
| 6,074,310 | A | | 6/2000 | Ota | 473/345 |
| 6,296,576 | B1 | * | 10/2001 | Capelli | 473/326 |
| 6,352,482 | B1 | | 3/2002 | Jacobson et al. | 473/310 |
| 2003/0013547 | A1 | | 1/2003 | Helmstetter et al. | |

OTHER PUBLICATIONS

Gere, J. M., "Mechanics of Materials", Pacific Grove, USA: Brooks/Cole, 2001, pp. 891-892.

"Rules of Golf" (extract).

Cochran, A. and J. Stobbs, *Search for the Perfect Swing*, Chicago: Triumph Books, 1968, p. 147.

* cited by examiner

GOLF CLUBS

FIELD OF THE INVENTION

This invention relates to golf clubs and is concerned especially with improvements for reducing backspin in putters and fairway-wood clubs by improved implementation of vertical gear-effect.

BACKGROUND TO THE INVENTION

Vertical gear-effect relies on the principle that impacts above or below the point of central impact (the "sweet spot") on the face of a golf club cause the club head to rotate about its pitch axis (i.e., the heel-toe axis through the club-head center of mass) and, since the ball is in contact with a rotating striking surface, the ball also rotates but in the reverse direction. The spin directions of the club head and ball are likened to those in a pair of gear wheels.

The amount of imparted spin on the golf ball is found to be directly proportional to the distance of the club-head center of mass behind the impact face so golf clubs, such as irons, exhibit negligible gear-effect since each has its center of mass on, or close to, the impact face. By contrast, putters and fairway woods are commonly designed to have their center of mass some distance behind the impact face and can thus exhibit significant gear-effect.

In putters, vertical gear-effect is used to reduce or reverse imparted backspin. A ball launched on a putting surface with backspin loses more kinetic energy and pace through initial skidding compared to a ball with no backspin, or more preferably with overspin. This reduction of initial skid promotes ball roll and improves distance and (allegedly) direction control.

In fairway-woods, vertical gear-effect is used to increase ball carry by increasing elevation trajectory angle and reducing backspin. Most golf clubs are lofted and thus impart backspin to a golf ball by means of oblique impact. For distance shots, this backspin is a major advantage, since backspin gives the ball aerodynamic lift and allows it to remain airborne longer and thus fly longer. However, too much backspin increases aerodynamic drag (which reduces carry distance) and lifts the ball too much, so the ball climbs high in the air but at the expense of losing more distance. Vertical gear-effect can reduce this problem by contributing higher initial launch trajectory (as in high-lofted clubs) but counteracts the oblique-impact spin mechanism and reduces backspin.

An important requisite of gear-effect is that the golf club head behaves (at least to some extent) as a free body during impact. This "free body" behavior is established teaching in golf science and assumes that during the very brief time of contact (circa half a millisecond), the shaft has negligible influence on the outcome of the impact (see for example: A. Cochran and J. Stobbs, *Search for the Perfect Swing*, Chicago: Triumph Books, 1968, p. 147).

Thus, the launch velocities and spin vectors of a ball immediately after impact from a club head are predicted from a "free body model" of the ball and club head that ignores any effect of the mass or rigidity of the shaft. United States Patent Application Publication 2003/0013547 (Helmstetter et. al.) exemplifies such teaching of club-on-ball impact, where shaft effects are ignored and only the mass and inertial parameters of a club head, measured to several significant digits, are used to compute very small, theoretical differences in ball flight behavior. Any off-center impact on the club-face imparts rotation on the club head and the free body model teaches that this rotation occurs about an axis through the center of mass of the club head.

SUMMARY OF THE INVENTION

According to the present invention, there is provided a golf club comprising a shaft and a club head, the shaft having a longitudinal axis and a tip-end attached to the club head, and the club head having a center of mass, a heel-toe axis through the center of mass and a radius of gyration K millimeters about the heel-toe axis, wherein the attachment of the tip-end of the shaft to the club head has compliance about a rotational axis through the center of mass, the rotational axis having a perpendicular orientation to the shaft axis in a plane parallel to the shaft axis and containing the heel-toe axis, and wherein the compliance is not less than the force-couple bending compliance of a length of 1000/K millimeters of the shaft measured from the tip-end, and the rotational axis is spaced by less than 0.33K millimeters from the shaft axis.

The present invention is based on analysis of overall club inertia and shaft deformation modes, which shows that a golf club shaft has negligible influence on club head rotation about the "free body" rotation axis parallel to the shaft but strongly opposes rotation about any axis perpendicular to the shaft.

In golf clubs, the shaft axis is typically 55 to 70 degrees upright so the axis of a shaft is more closely aligned to the vertical than to the horizontal. This difference means that club head yaw rotation (about the principal vertical axis) matches the free body model more closely than pitch rotation (about the principal heel-toe axis). Furthermore, the club head moment of inertia about the yaw axis is by design much greater than that for pitch rotation, which again helps to make yaw rotation obey the free body model more accurately. However, the anti-rotation effect of a shaft is strongly dependent on orientation, being negligible for rotation parallel to the shaft and very significant perpendicular to the shaft. This introduces a skew error in the rotational behavior of a club head at impact which, in turn, creates errors in ball flight. For example, the axes for bulge and roll in a wood-type club-head should take account of this skew effect to minimize dispersion, but this is not found in prior art.

It has thus been realized that performance enhancements are obtained if the shaft attachment is arranged to allow the club head to behave more closely to the free body model for pitch rotation. The axis of this rotation has a perpendicular orientation to the shaft axis and lies in a plane parallel to the shaft axis and containing the heel-toe axis through the center of mass; for convenience this axis will be referred to as the "PS" (perpendicular to shaft) axis, its conjugate axis, parallel to the shaft axis, as the "FB" (free body) axis, and the center of mass as "CM".

The PS axis is desirably spaced from the shaft axis by not more than 4.25 millimeters, or preferably by less than 2.0 millimeters. Its spacing from the shaft attachment is desirably less than 2K millimeters, or preferably less than K millimeters.

The center of mass CM of the golf club of the invention is desirably located not less than 10 millimeters, and preferably not less than 15 millimeters, behind the impact face of the golf club. Furthermore, the center of mass CM is desirably located not more than 13 millimeters, and preferably not more than 10 millimeters, above the sole of the club.

The compliance of the attachment is desirably not less than the force-couple bending compliance of a length of 3000/K millimeters, or preferably 10000/K millimeters, of the shaft measured from the tip-end.

The club head may have a compliant crown, and in this case the attachment of the shaft tip-end to the club head may include a hosel-member attached to the crown.

The impact face of the golf club of the invention may be lofted, and the loft angle may be less than 30 degrees. Furthermore, it may have a height less than:

$$[21.3\times(1-\sin\alpha_{ss})+15]$$

millimeters where $\alpha_{ss}$ is the loft angle at the sweet spot of the impact face.

BRIEF DESCRIPTION OF THE DRAWINGS

Golf clubs in accordance with the present invention will now be described, by way of example, with reference to the accompanying drawings, in which.

DETAILED DESCRIPTION OF THE PREFERRED EMBODIMENTS

Figure 1:
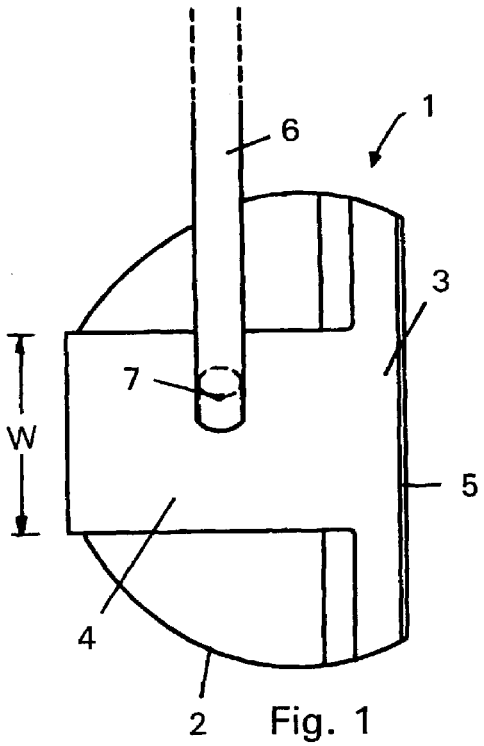
FIG. 1 is a top elevation of the putter-head and shaft attachment of a putter according to the invention.
Figure 2:
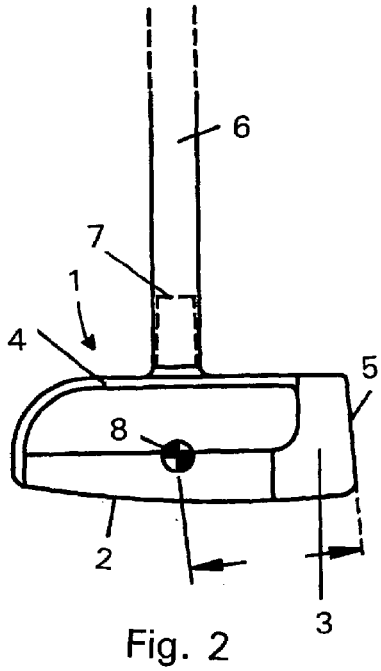
FIG. 2 is a side-elevation of the putter of FIG. 1.

Referring to FIGS. 1 and 2, a putter-head 1 comprises a stainless steel sole plate 2 and an aluminum upper part with an impact portion 3 and a crown plate 4. The outer surface of the impact portion provides an impact face 5 for striking a golf ball. A shaft 6 is bonded onto an over-hosel stub 7, which is rigidly attached centrally to the upper surface of the crown plate 4 such that the axis of the shaft 6 passes through the center of mass ("CM") 8 of the putter-head 1.

The sole plate 2 is attached at its forward end to the lower interior face of the impact portion 3, and at its rear end to the inside face of the turned-down end of the crown plate 4. Most of the overall mass of the putter-head is provided by the sole plate 2 and this ensures that CM 8 is located (say) 25 to 35 millimeters behind the impact face 5 and not more than 7 to 8 millimeters above the bottom surface of the putter-head. This location of the CM of the putter head provides high "vertical gear-effect" for advantageously imparting topspin on a golf ball.

The impact portion 3, over-hosel stub 7 and crown plate 4 are of one-piece construction and preferably investment cast from high-strength aluminum alloy. Other high-strength, low-density materials (e.g., molded composites) and methods of fabrication can be used. The design aim of this high-strength low-density part is to form a low mass, high-rigidity interface between the impact face 5 and the sole plate 2 and to provide rugged but compliant attachment of the shaft 6 to the putter-head. The compliance is provided by elasticity in the crown plate 4, which is designed to be compliant to pitch rotation of the putter-head relative to the shaft. Pitch rotation, which is rotation of the putter-head about its CM in the plane of FIG. 2, is necessary to implement vertical gear-effect.

The dimensions and the material properties of the crown plate 4 determine the degree of pitch compliance between the putter-head 1 and the shaft 6. Pitch compliance is defined as the tendency to deform elastically when subjected to a force couple causing pitch rotation and is measured in degrees per unit force couple load. The thickness of the crown plate 4 is 2 millimeters, its width (W) 42 millimeters and its length from its junction with the impact portion 3 to its junction with the sole plate 2 is greater than 50 millimeters.

Figure 3:
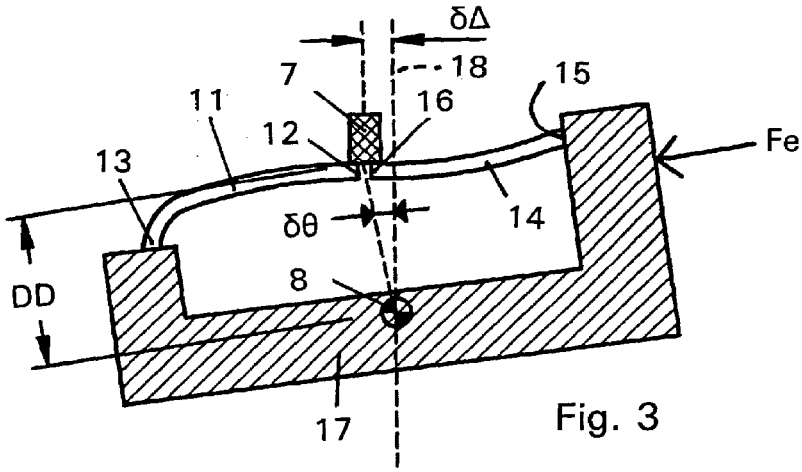
FIG. 3 is a theoretical model of the shaft attachment means in the putter of FIGS. 1 and 2.

FIG. 3 is a diagram of a theoretical model for the shaft attachment of the putter of FIGS. 1 and 2. In this model, the crown plate 4 is represented as consisting of a rear cantilever beam 11 having a free end 12 and fixed end 13, a front cantilever beam 14 having a fixed end 15 and free end 16, and a rigid over-hosel stub 7 by which bending and deflection loads are applied to the free ends 12 and 16, simultaneously. The fixed ends 13 and 15 of the cantilever beams 11 and 14, respectively, are rigidly attached to the body 17 of the putter-head, and the free ends 12 and 16 are spaced by distance DD from CM 8. The length of each beam 11 and 14 is taken to be 25 millimeters.

As illustrated in FIG. 3, the line of action of an eccentric impact force Fe is offset from CM 8 so that the putter-head is subjected to an anti-clockwise rotation of $\delta\theta$ from its pre-impact position; broken line 18 shows the axis of the stub 7 in its pre-impact position. The cantilever beams 11 and 14 are elastically bent (as shown) to accommodate the club-head rotation. The rotation is opposed by stiffness in the shaft (not shown in FIG. 3), and the stub 7, which in the absence of the shaft, would rotate through an angle $\delta\theta$, is kept substantially in its pre-impact angular orientation by virtue of this stiffness. The stub 7, however, is laterally and vertically displaced.

The lateral displacement $\delta\theta$ equals $[DD\times\sin\delta\theta]$ and is accommodated by displacement of the shaft since the force required to deflect the tip laterally of the shaft is relatively very small. The vertical displacement $[DD\times(1-\cos\delta\theta)]$ is negligible and is accommodated by vertical compliance in the cantilever beams arrangement. Thus the shaft reaction on the hosel is almost entirely a force-couple opposing anti-clockwise rotation.

The putter shaft 6 is typically made of high strength steel with tubular section of diameter 9.4 millimeters and wall thickness 0.6 millimeters. From this, the ratio of the moments of area of the shaft section to the cantilever section is 7.0. Applying the standard formula for circular bending of a cantilever beam (pure bending force couple at the free end), and knowing that the Young's modulus of elasticity for aluminium (the cantilever beams 11 and 14) is approximately one-third of that for steel (the shaft 6), the pitch compliance at the over-hosel stub 7 is approximately equal to the pitch compliance of a 260 millimeter length of attached shaft. In this comparison it is assumed that for the duration of impact, the shaft is immovably fixed at a distance 260 millimeters from the putter-head attachment point.

Figure 4A:
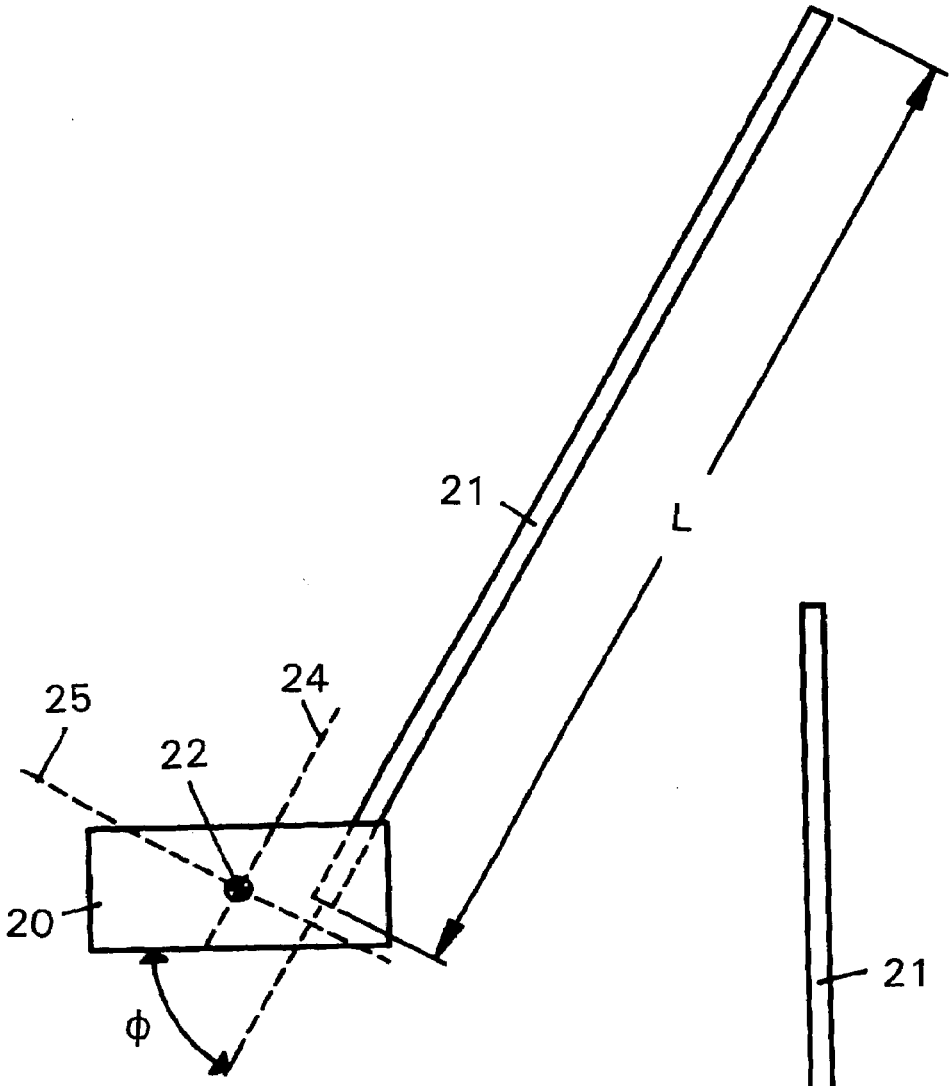
FIGS. 4(*a*) and 4(*b*) are schematic models of a golf club, defining axes and dimensions pertinent to the description of the invention.
Figure 4B:
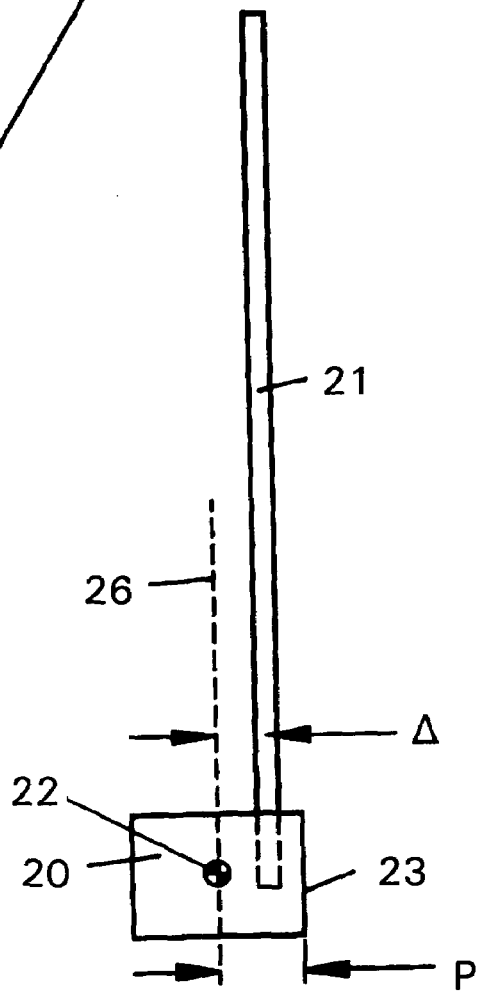

FIGS. 4(*a*) and 4(*b*) are front and side elevations respectively of a hypothetical golf club. The club head is a rectangular parallelepiped 20 and the attached shaft 21 is a constant diameter, uniform rod of length L millimeters and lie angle of $\phi$ degrees. The CM 22 is in the geometric center of the club head and positioned p millimeters behind the impact face 23. The FB axis 24 and PS axis 25 both pass through the CM 22 and are contained in a vertical plane 26 which is offset $\Delta$ millimeters from the shaft axis.

For simplicity, it is assumed that the radii of gyration of the club head for rotation about the FB and PS axes are equal and of value $K_M$. If the FB axis is displaced from the shaft axis by $\Delta_M$, the mass of the club head is M1 kilograms and the mass of the shaft is M2 kilograms, the moment of inertias (MOIs) of the whole club (assuming it is a perfectly-rigid body) for rotation about the FB axis 24 and rotation about the PS axis 25 are as follows:

$$MOI(FB\text{ axis})=M1\times(K_M)^2+M2\times(\Delta_M)^2 \quad (1)$$

$$MOI(PS\text{ axis})=M1\times(K_M)^2+M2\times L^2/3 \quad (2)$$

Since $\Delta_M$ is usually less than $K_M$, and M2 is about half M1, the MOI of the entire club about the FB axis is not much more than that of the club head alone. Conversely, the shaft length L is about forty times $K_M$, so the MOI of the whole club about the PS axis is about 270 times the MOI of the club head alone. This shows that shaft inertia is small for rotation about an axis parallel to the shaft axis but is extremely high for rotation about any axis perpendicular to the shaft. In fact, it is so high in this mode that most of the upper part of the shaft can be regarded as being fixed in space during impact.

Thus, high inertia reduces the effective length of the shaft so that it acts like a short, and therefore very stiff, cantilever beam with its distal end fixed by inertia forces and its free end loaded by various forces generated by the club head rotating about its CM. By providing high compliance at or near the shaft entry point (on the club head) the free rotation of the club head is less restrained by the stiffness of this cantilever beam. Shaft-attachment compliance can, therefore, be related to an "effective length" of shaft and, in this respect, it is considered, according to the invention, that a minimum useful compliance in a club head is not less than that of a shaft of length 1000/K millimeters, but is more preferably greater than a shaft of length 3000/K, or more preferably 10000/K. These preferred lengths are inversely proportional to the radius of gyration of the club head about its principal heel-toe axis so that attachment compliance decreases as the moment of inertia for pitch rotation increases. This takes account of the fact that the rate of rotation for a given eccentric impact is nearly inversely proportional to club head moment of inertia, so club heads of higher inertia need less shaft attachment compliance. The radius of gyration K (about the heel-toe axis) is closely similar in magnitude to the radius of gyration about the PS axis; the value of inertia about the heel-toe axis is a standard measurement performed on club heads.

The preferred shaft attachment criteria stated above are dependent on the bending and axial deformation properties of the shaft. In practice shaft bending properties from one club type to another do not vary to a great degree since a shaft that is greatly stiffer than average and one that is much more flexible than average are both undesirable and difficult to play with. For reference purposes, it is assumed that the shaft for a putter according to the invention is equivalent to that specified in the description of FIGS. 1 and 2 whereas the shaft for a wood-type club is taken to be a "regular" stiffness shaft in common use.

The present invention relies on data for the static behavior of shafts and shaft attachment means rather than the actual dynamic behavior. As research and knowledge of this new area of club design advances, design criteria can be refined to take account of dynamic effects.

Figure 5:
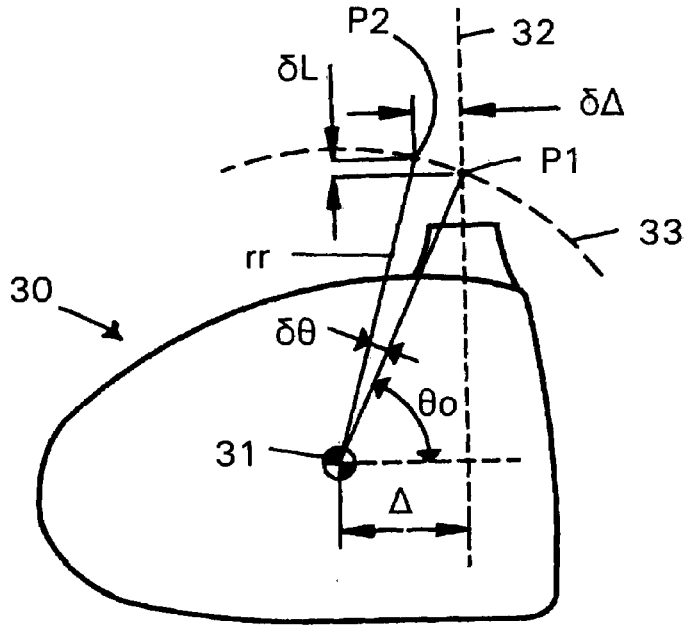
FIG. 5 is a side elevation of a metal-wood club-head, illustrating rotation about the pitch axis.

Referring to FIG. 5, a metal-wood club-head 30 has its CM 31 displaced a from the hosel axis 32. A point P1 on axis 32 and near the entry bore of the hosel is disposed at radius rr from the CM 31. Prior to impact, radius rr subtends an angle $\theta_0$ to the horizontal. During impact, which causes anti-clockwise pitch rotation of $\delta\theta$ about the CM, the point P1 moves in a circular arc 33 of radius rr to point P2. If the club head is to rotate, movement of the shaft and/or the shaft attachment means must accommodate this shift from P1 to P2. Such movement has a linear vertical component $\delta L$ equal to $[\Delta\times\sin\delta\theta]$, a linear horizontal component $\delta\Delta$ equal to $[rr\times\sin\theta_0\times\sin\delta\theta]$ and an angular component $\delta\theta$. From this, the need for axial forces to shorten or elongate the shaft can be almost eliminated by making $\Delta$ zero, and the need for lateral forces to deflect the shaft in the plane of rotation can be reduced by arranging that the shaft attachment is very short and very close to the rotation axis (but this is impractical). However, the angular component $\delta\theta$ is unavoidable wherever the shaft attachment is positioned.

Analysis shows that the vertical displacement $\delta\theta$ generates a substantial reactive force that produces a large moment opposing rotation, whereas the horizontal displacement $\delta\Delta$ has negligible anti-rotation effect. It is thus desirable to minimise $\delta L$ by arranging that $\Delta$ is small in club heads according to the invention and preferably less than 0.33K. Furthermore, for values $\Delta$ greater than the shaft radius, the anti-rotation moment caused by $\delta L$ becomes large compared to the moment caused by the shaft or shaft attachment bending through $\delta\theta$. Thus it is desirable to have a not greater than 4.25 millimeters (which is the radius of a standard shaft used in wood clubs), but more preferably $\Delta$ should be less than 2 millimeters or nominally zero. Even with very small $\Delta$ some vertical movement arises so it is desirable to ensure that the shaft attachment means has linear compliance for movement along the shaft axis as well as rotational compliance about the PS axis.

Figure 6:
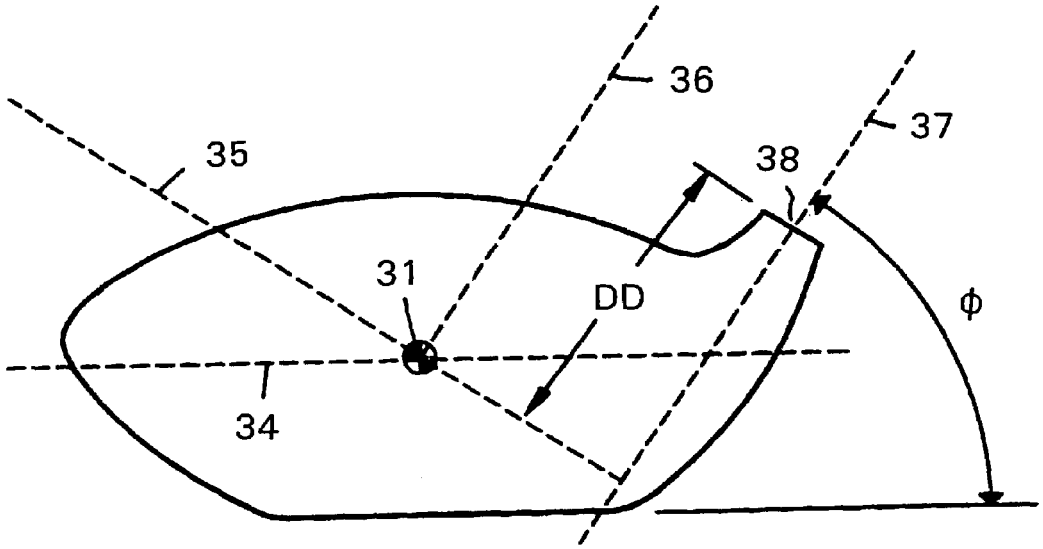
FIG. 6 is a front elevation of the club head of FIG. 5, showing the relationship of pitch and PS axes.

FIG. 6 shows the heel-toe pitch axis 34, a PS axis 35 and a FB axis 36 (which is parallel to the shaft axis 37) all passing through the CM 31 of the club head 30. The PS axis 35 is inclined at $(90-\phi)$ degrees to the pitch axis 34, where $\phi$ degrees is the shaft lie angle. Shaft stiffness primarily opposes club head rotation about the PS axis 35 but, because the PS axis 35 is inclined by only 30 to 35 degrees to the pitch axis 34, pitch rotation is also strongly affected. As stated above, pitch rotation (and thus rotation about the PS axis 35) causes unavoidable angular displacement $\delta\theta$ between the shaft and club head. Linear displacements $\delta\Delta$ and $\delta L$ are, however, reducible by ensuring that the shaft attachment is close to the PS axis 35 or pitch axis 34. It is thus desirable to ensure that the distance DD from the shaft attachment point 38 to the PS axis 35 is no more than 2K millimeters, but more preferably K millimeters.

A number of factors determine shaft attachment compliances. These factors include the position of the shaft attachment relative to the club head pitch axis, the compliance of the substrate to which the hosel is attached, the compliance of the hosel and the compliance of any cushioning material between the shaft and the hosel bore (including bonding agents). The consequent reduction in rotation stiffness advantageously limits stress on the shaft tip and reduces shaft-transmitted vibrations.

An aim of the present invention is to maximize shaft attachment compliance without compromising the ruggedness and integrity of the attachment means. There are often two elements of compliance, one comprising a relatively soft elastic interface between the shaft tip and the hosel bore (e.g., a rubber toughened adhesive), and the other being the hosel itself and the substrate to which the hosel is attached. Thus a shaft may be bonded into a slightly oversize bore using flexible adhesive so that the compliance is high up to the point that the shaft is able to twist relative to the hosel bore. This gives an initial high compliance, limited to a small twist small range of angular deflection, so the overall compliance for large angular deflections is non-linear. For putters angular deflections of at least ±0.5 degrees are desirable whereas for wood clubs much higher angular deflections are preferred. Providing high initial compliance within the hosel bore in long hitting clubs is probably limited to deflections not much greater than ±2 degrees although higher deflections may be possible. Analysis shows that impact rotation in wood clubs can exceed ±5 degrees and in these circumstances it is preferable to provide linear compliance by means of elasticity in the substrate around the hosel rim.

Figure 7A:
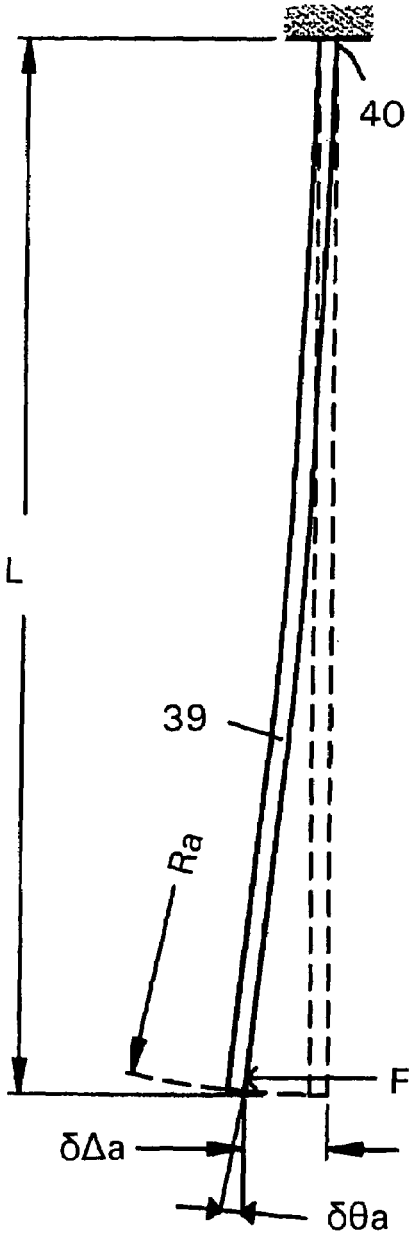
FIGS. 7(*a*) and 7(*b*) are illustrative respectively of lateral-deflection deformation and force-couple bending of a length of golf-club shaft.
Figure 7B:
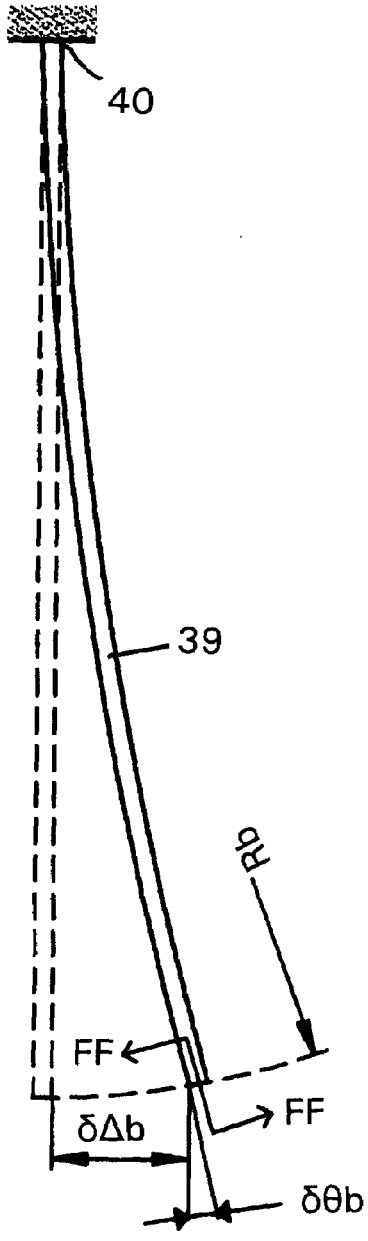

In FIGS. 7(*a*) and 7(*b*) a shaft 39 has effective length L and is assumed to be stationary during impact at its fixed end 40. In FIG. 7(*a*), a lateral force F deflects the tip of the shaft $\delta\Delta a$ to the left and rotates the tip clockwise through a small angle $\delta\theta a$. The bending curvature in the shaft 39 is a maximum at the fixed end 40 and reduces to zero at the tip. For small deflections the locus of the tip is a circle of radius Ra equal to five sixths of the effective length L. The force required to deflect the shaft 39 in this mode is proportional to $[\delta\Delta a \times L^{-3}]$.

In FIG. 7(*b*) a force couple FF rotates the tip of the shaft 39 anti-clockwise through angle $\delta\theta b$ and deflects the tip to the right by $\delta\Delta b$. The bending curvature in the shaft 39 is constant throughout its length so the shaft axis is bent into a circle. For small deflections the locus of the tip is a circle of radius Rb equal to three quarters of the effective length L. The force couple required to rotate the tip of the shaft in this mode is proportional to $[\delta\theta b \times L^{-1}]$ and this is relatively much greater than the force moment (acting about the CM of the club head) required to deflect the tip as in FIG. 7(*a*).

The shaft deformations described above pertain to an impact that rotates the club head anti-clockwise (viewed from the toe end as in FIG. 5). It is thus evident that, provided the shaft axis and pitch axis are in nearly the same plane, the force couple FF that opposes rotation is much more significant than forces overcoming lateral displacement of the tip.

Figure 8:
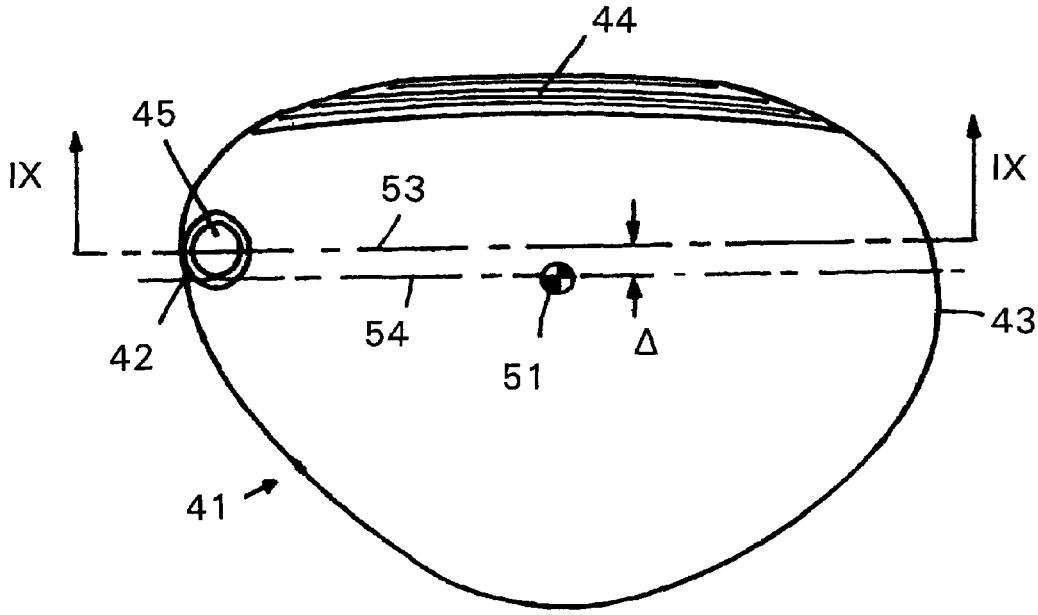
FIG. 8 is a top elevation of a metal-wood club-head and hosel according to the invention.
Figure 9:
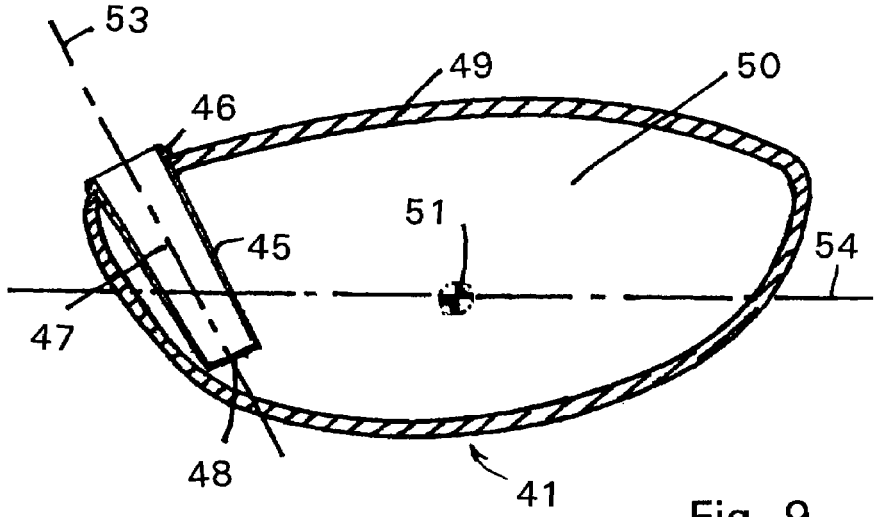
FIG. 9 is a sectional side-elevation of the club head of FIG. 8, the section being taken on the line IX—IX of FIG. 8.

Referring to FIGS. 8 and 9, a metal-wood club-head 41 has a heel 42, a toe 43, an impact face 44 and a hosel 45. The hosel 45 comprises an attachment rim 46, a tapered bore 47 and a closed free-end 48. The rim 46 is welded or otherwise attached to the shell 49 of the club head and the free end 48 extends some way into the inner cavity 50 of the club head. When fitted into the hosel, the axis of the shaft is no more than 15.87 millimeters from the back of the heel 42 as required by the "Rules of Golf".

Figure 10:
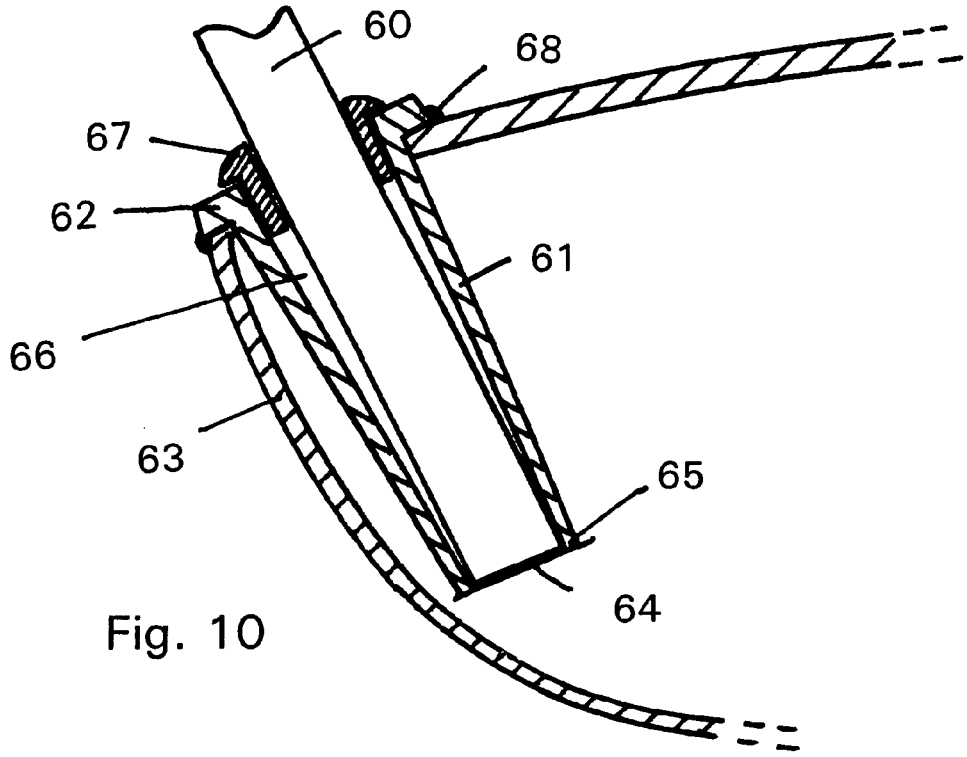
FIG. 10 is an enlarged sectional view of part of the metal-wood club-head of FIGS. 8 and 9 illustrating details of the hosel arrangement for shaft attachment.

The club head 41 has a CM 51, and the axis 53 of the hosel 45 lies in a vertical plane parallel to the heel-toe axis 54 through the CM 51 and is offset horizontally from the heel-toe axis 54 by amount $\Delta$. By arranging that $\Delta$ is small or zero, a major component of shaft stiffness is minimized so the remaining rotational stiffness is mainly due to angular displacement ($\delta\theta$) between the shaft and head. This component can be reduced by arranging that the head-rotation forces act on the shaft close to, or below, the heel-toe axis 54. This is exemplified in FIG. 10, which shows a shaft tip 60 in place in an elongate hosel 61 attached at its rim 62 to the shell 63 of the club head.

A thin metal shim 64 or the like is welded or otherwise attached to the free end 65 of the hosel where the hosel bore is a close fit to the shaft tip. The purpose of the shim 64 is to seal the free end of the hosel 61 with a low rigidity means. Alternatively, the free end of the hosel 61 is sealed after the head (without shaft) is assembled. The seal can be formed with low-density, flexible filler, which is forced through the (open) free end 65 of the hosel 61 and fills the gap between the hosel end 65 and the adjacent inner surface of the head shell 63. The filler presents negligible resistance to relative movement between the free end 65 and the head shell 63. During shaft assembly, adhesive is retained within the sealed end of the hosel 61 and fills the void between the shaft 60 and the hosel 61 to form a strong but compliant bond.

The bore of the hosel 61 tapers to form a slightly conical cavity with a clearance 66 between shaft and hosel-wall, that is larger nearer the rim 62. The shaft 60 is bonded into the hosel bore using a high strength, semi-flexible adhesive (not shown). The cured adhesive is soft compared with the shaft and the body of the hosel, and this allows the shaft to tilt about its extremity inside the hosel bore. The hosel 61 is slightly compliant so that it deflects at its free end 65; this assists the club head to rotate about the heel-toe axis 54 at impact. Additionally, the region of the shell 63 surrounding the hosel 61 may be thin and compliant so that the entire hosel 61 can deflect relative to the CM during impact. A collar part 67, which aligns the shaft and hosel axes during assembly, is of a material that is soft and flexible to head rotation during impact.

Figure 11:
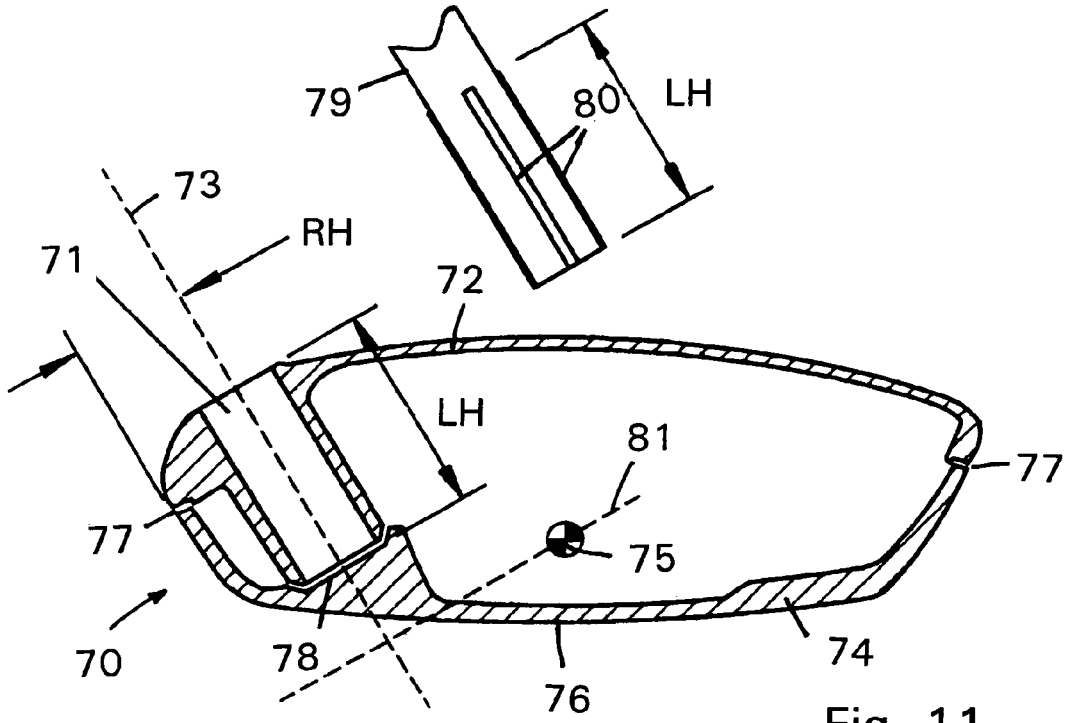
FIG. 11 is illustrative of another metal-wood golf-club according to the invention, showing the club-head in sectional side elevation together with a part of the shaft for attachment to it.

Referring to FIG. 11, a hollow, 'fairway-wood' club-head 70 has an impact-face loft angle in the range 13 to 30 degrees, a hosel 71 and a low-mass upper shell 72. The shell 72, which defines the crown and upper parts of the side and rear walls, is cast in a high strength magnesium or aluminium alloy, or may be molded in high strength polymer or the like. In the assembled club (not shown), the shaft axis is collinear with the hosel axis 73.

A lower shell 74 of the club head 70, which is cast or otherwise fabricated from steel or amorphous metal, provides the impact face of the club and defines the lower parts of the sides and rear walls, together with the base or sole of the club head. The material of the lower shell 74 has a greater density than that of the upper shell 72, is of generally different and variable-section thickness such that the CM 75 is not more than 13 millimeters, but more preferably less than 10 millimeters, above the lowest part of the sole 76. The weight is also distributed towards the side walls to increase the moment of inertia about the vertical axis through the CM 75.

The upper and lower shells 72 and 74 are bonded together at a peripheral butt joint 77 and the open end of the bottom of the hosel 71 mates with a closure plate 78 on the lower shell 74. The seal formed between the closure plate 78 and the hosel 71 is loose but sufficient to retain adhesive (not shown) within the hosel 71 during shaft attachment.

Prior to attachment to the club head, the end part of the shaft 79 (shown separately) has three or more compliant guide strips 80 bonded along its length to act as spacers between the shaft diameter and the hosel bore during assembly. The length $L_H$ of the hosel bore is preferably not greater than 25 millimeters but longer lengths may be used. The diameter of the hosel bore is at least 0.5 millimeters greater than the diameter of the tip end of the shaft 79 but may be greater by 1.0 millimeters or more. The adhesive used to bond the shaft 79 into the hosel 71 is preferably a high toughness flexible epoxy or a toughened acrylic or the like. The cured hardness of the adhesive is chosen to provide adequate rigidity between the shaft and club head during a golf swing so that the head movement relative to the shaft is negligible prior to impact. During impact, the compliance provided by the adhesive and guide strips 80 allow the shaft tip to move within the hosel bore so that the club head is freer to rotate about the PS axis 81.

The PS axis 81 falls below the club head on the shaft axis side (i.e., the heel side). Consequently, the shaft axis should be positioned away from the heel extremity to allow the bottom of the hosel 71 to be close to the PS axis. However, the "Rules of Golf" require that the distance $R_H$ between the back of the heel and the shaft axis does not exceed 0.625 inches (15.87 millimeters). It is thus preferable that $R_H$ is not more than 15.5 millimeters, which allows a small margin of error in manufacture.

Figure 12:
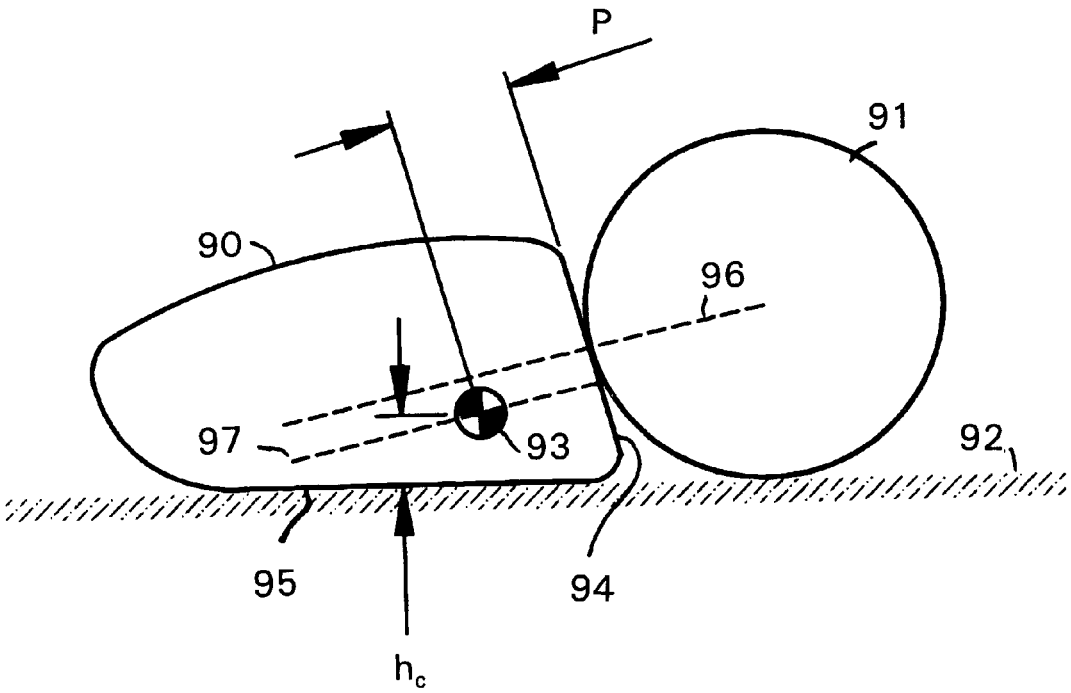
FIG. 12 is a sectional side elevation of a fairway-wood club-head according to the invention, and a golf ball.

FIG. 12 shows a metal- or composite-wood club-head 90 of the "fairway-wood" type and a golf ball 91 resting on a grass surface 92 just prior to impact. The club head has a CM 93 p millimeters behind the impact face 94 and $h_c$ millimeters above the sole 95 (lowest surface) of the club head.

Fairway-wood shots are typically played on the fairway or on light rough with the ball resting on the ground. It these circumstances it is impractical to strike the ball with upward club head trajectory but instead the club head approaches the ball with a slight downward trajectory or with trajectory parallel to the ground. In contrast, driver clubs are designed to strike a "teed-up" golf ball, which is raised several millimeters off the ground so the sole of the driver can be underneath the ball at impact and the club head normally has significant upward trajectory. Although drivers are sometimes used off the fairway and fairway-woods are often used off a tee, these differences in stroke lead to important differences in head design. It is one of the aims of the present invention to improve the design of fairway-woods for fairway and other ground shots.

In FIG. 12 the club-head trajectory is parallel to the ground at impact and the club head makes contact with the grass surface 92 such that the sole 95 and the bottom of the golf ball are approximately coplanar. This stroke-style imparts maximum initial launch angle on the ball and allows the ball to contact high on the face. Other styles may be adopted, but generally a club head that is designed to perform well for this stroke-style will also perform well with slightly steeper "attack angle".

Steeper attack angle (downward head trajectory) reduces initial ball-elevation trajectory and tends to increase backspin. An aim of the invention is to compensate for these changes by providing vertical gear-effect to increase initial loft trajectory and reduce backspin as the attack angle becomes steeper. Increasing attack angle also increases the point of impact on the club-face and this, in turn, reduces backspin and increases ball trajectory through vertical gear-effect. By this means a fairway-wood club can be designed to give near optimum ball-flight trajectory for a given swing speed (dependent on a golfer's ability) and maximize performance for small variations in attack angles and impact height. The sense of vertical gear-effect need not be positive (meaning that the club head rotates with backspin on impact) to have optimum flight trajectory. Gear-effect may be used to assist backspin in some instances, but the principle that higher point of impact reduces backspin and increases trajectory through gear-effect, still holds. However, lowering CM and increasing p is much favoured in recent fairway-wood designs and this suggests that positive vertical gear-effect in fairway-woods is generally beneficial.

Positive vertical gear-effect depends on the line of impact 96 being above the CM 93. Given that the radius of a golf ball is 21.3 millimeters, the condition to impart positive vertical gear-effect for a "flat" attack angle is:

$$h_c < 21.3 - (21.3 + p) \times \sin \alpha_{ss} \quad (3)$$

where $\alpha_{ss}$ is the loft angle at the sweet spot. The sweet spot is defined as the point on the club-face where a line from the CM normal to the impact face 94 meets the impact face; this line is shown by the dashed line 97 in FIG. 12. For a typical 3-wood design with loft of 14 degrees and p value of 12 millimeters, the value of $h_c$ required to achieve positive vertical gear-effect is just over 13 millimeters (assuming the impact condition of FIG. 12). Thus, for preference, the value of $h_c$ should not be more than 13 millimeters.

Even greater positive gear-effect is achieved if $h_c$ is reduced below the values suggested above. With less skilled golfers, the ball is often "hit thin", meaning that the club head is slightly high off the ground at impact. To ensure that "positive vertical gear-effect" is imparted even when the club sole is raised by about 3 millimeters from the ground, the value of $h_c$ should be limited as follows:

$$h_c < 18 - (21.3 + p) \times \sin \alpha_{ss} \quad (4)$$

The spin imparted by gear-effect is proportional to p, the distance in millimeters of the CM behind the sweet spot, and to the height of the line of impact above the CM. Preferably p should be at least 10 millimeters for significant gear-effect but more preferably not less than 15 millimeters. Since it is desirable to minimize the height of the CM, the height of the impact face in a fairway-wood is advantageously not greater than the highest impact for a lightly "grounded" sole at impact plus an allowance for contact deformation and de-lofting. High velocity impact flattens the ball surface into a 20 to 25 millimeters disc so it is desirable to have 12.5 millimeters allowance for the impact footprint plus 2.5 millimeters for attack angle de-lofting and other effects. Thus it is preferable to have face height limited to $[21.3 \times (1 - \sin \alpha_{ss}) + 15]$ millimeters. This gives adequate impact area for the great majority of shots and helps to lower CM.

For three examples of golf club, namely a 3-wood, a 7-wood and a putter, according to the invention, the values of the parameters $h_c$ (height in millimeters of CM above the sole), p (distance in millimeters of the CM behind the sweet spot), M (mass in kilograms of the club head), $\alpha_{ss}$ (the loft angle in degrees at the sweet spot) and K (the radius of gyration in millimeters of the club head about the heel-toe axis through the center of mass) are given by the following Table.

TABLE

| | 3-Wood | 7-Wood | Putter |
|---|---|---|---|
| $h_c$ | 12.7 | 9.5 | 7.5 |
| p | 12 | 10 | 30 |
| M | 0.21 | 0.23 | 0.32 |
| $\alpha_{ss}$ | 14 | 22 | 2 |
| K | 22 | 19 | 14 |

The invention claimed is:

1. A golf club comprising a shaft and a club head, the shaft having a longitudinal axis and a tip-end attached to the club head, and the club head having a center of mass, a heel-toe axis through the center of mass and a radius of gyration K millimeters about the heel-toe axis, wherein the attachment of the tip-end of the shaft to the club head has compliance about a rotational axis through the center of mass, the rotational axis having a perpendicular orientation to the shaft axis in a plane parallel to the shaft axis and containing the heel-toe axis, and wherein the compliance is not less than the force-couple bending compliance of a length of 1000/K millimeters of the shaft measured from the tip-end, and the rotational axis is spaced by less than 0.33K millimeters from the shaft axis.

2. The golf club according to claim 1 including an impact face located not less than 10 millimeters in front of the center of mass.

3. The golf club according to claim 1 including an impact face located not less than 15 millimeters in front of the center of mass.

4. The golf club according to claim 1, wherein the club has a sole located not more than 13 millimeters below the center of mass.

5. The golf club according to claim 1, wherein the club has a sole located not more than 10 millimeters below the center of mass.

6. The golf club according to claim 1, wherein the club has a sole located less than:

$$21.3-(21.3+p)\times\sin\alpha_{ss}$$

millimeters below the center of mass, where p is the distance in millimeters of the center of mass behind the sweet spot of the club impact-face, and $\alpha_{ss}$ is the loft angle of the impact-face at the sweet spot.

7. The golf club according to claim 1, wherein the club has a sole located less than:

$$18-(21.3+p)\times\sin\alpha_{ss}$$

millimeters below the center of mass, where p is the distance in millimeters of the center of mass behind the sweet spot of the club impact-face, and $\alpha_{ss}$ is the loft angle at the sweet spot.

8. The golf club according to claim 1, wherein the compliance of the attachment is not less than the force-couple bending compliance of a length of 3000/K millimeters of the shaft measured from the tip-end.

9. The golf club according to claim 1, wherein the compliance of the attachment is not less than the force-couple bending compliance of a length of 10000/K millimeters of the shaft measured from the tip-end.

10. The golf club according to claim 1, wherein the rotational axis is spaced from the shaft axis by not more than 4.25 millimeters.

11. The golf club according to claim 1, wherein the rotational axis is spaced from the shaft axis by less than 2.0 millimeters.

12. The golf club according to claim 1, wherein the shaft-attachment and the rotational axis are spaced apart by less than 2K millimeters.

13. The golf club according to claim 1, wherein the shaft-attachment and the rotational axis are spaced apart by less than K millimeters.

14. The golf club according to claim 1, wherein the club head has a compliant crown, and the attachment of the shaft tip-end to the club head includes a hosel-member attached to the crown.

15. The golf club according to claim 1 having a lofted impact face, wherein the impact face has a loft angle less than 30 degrees.

16. The golf club according to claim 1 having an impact face with a height less than:

$$[21.3\times(1-\sin\alpha_{ss})+15]$$

millimeters where $\alpha_{ss}$ is the loft angle at the sweet spot of the impact face.

17. A golf club comprising a shaft and a club head, the shaft having a longitudinal axis and a tip-end attached to the club head, and the club head having a center of mass, a heel-toe axis through the center of mass and a radius of gyration K millimeters about the heel-toe axis, the attachment of the tip-end of the shaft to the club head has compliance about a rotational axis through the center of mass, the rotational axis having a perpendicular orientation to the shaft axis in a plane parallel to the shaft axis and containing the heel-toe axis, and wherein the compliance is not less than a force-couple bending compliance of a length of 1000/K millimeters of the shaft measured from the tip-end, and the rotational axis is spaced by less than 0.33K millimeters from the shaft axis, the club has a sole located less than:

$$18-(21.3+p)\times\sin\alpha_{ss}$$

millimeters below the center of mass, where p is the distance in millimeters of the center of mass behind the sweet spot of the club impact-face, and $\alpha_{ss}$ is the loft angle at the sweet spot, and an impact face with a height less than:

$$[21.3\times(1-\sin\alpha_{ss})+15]$$

millimeters where $\alpha_{ss}$ is the loft angle at the sweet spot of the impact face.

18. A golf club comprising a shaft and a club head, the shaft having a longitudinal axis and a tip-end attached to the club head, and the club head having a center of mass, a heel-toe axis through the center of mass and a radius of gyration K millimeters about the heel-toe axis, wherein the attachment of the tip-end of the shaft to the club head has compliance about a rotational axis through the center of mass, the rotational axis having a perpendicular orientation to the shaft axis in a plane parallel to the shaft axis and containing the heel-toe axis, and wherein the compliance is not less than a force-couple bending compliance of a length of 1000/K millimeters of the shaft measured from the tip-end, and the rotational axis is spaced by less than 0.33K millimeters from the shaft axis;

the club has an impact face located not less than 10 millimeters in front of the center of mass and a sole located not more than 13 millimeters below the center of mass;

the compliance of the attachment is not less than the force-couple bending compliance of a length of 3000/K millimeters of the shaft measured from the tip-end;

the rotational axis is spaced from the shaft axis by not more than 4.25 millimeters;

the shaft-attachment and the rotational axis are spaced apart by less than 2K millimeters; and the club head has a compliant crown, and the attachment of the shaft tip-end to the club head includes a hosel-member attached to the crown.

* * * * *